US008056723B2

(12) United States Patent
Cavalcante

(10) Patent No.: US 8,056,723 B2
(45) Date of Patent: Nov. 15, 2011

(54) COLLAPSIBLE CONTAINER

(75) Inventor: Mauricio D. Cavalcante, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 189 days.

(21) Appl. No.: 12/425,262

(22) Filed: Apr. 16, 2009

(65) Prior Publication Data

US 2010/0264149 A1 Oct. 21, 2010

(51) Int. Cl.
*B65D 21/00* (2006.01)
*B65D 85/62* (2006.01)

(52) U.S. Cl. ..... 206/511; 206/506; 220/6

(58) Field of Classification Search ..... 220/4.28, 220/6; 206/501, 511, 512, 506
See application file for complete search history.

(56) References Cited

U.S. PATENT DOCUMENTS 3,981,410 A * 9/1976 Schurch ..... 220/6
4,662,532 A * 5/1987 Anderson et al. ..... 220/7
5,083,666 A * 1/1992 Lam ..... 206/506
5,503,275 A * 4/1996 Fesquet ..... 206/505
2007/0158345 A1* 7/2007 Booth et al. ..... 220/6

FOREIGN PATENT DOCUMENTS

| | | |
|---|---|---|
| EP | 0 579 158 A1 | 1/1994 |
| EP | 0 759 400 A2 | 2/1997 |
| GB | 2 369 350 A | 5/2002 |
| WO | 01/44060 A1 | 6/2001 |

OTHER PUBLICATIONS

Decision on Appeal for U.S. Appl. No. 11/264,371 mailed on May 11, 2009.

European Search Report for EP Application No. 10160234.0, Aug. 19, 2010.

* cited by examiner

*Primary Examiner* — Harry Grosso
(74) *Attorney, Agent, or Firm* — Carlson, Gaskey & Olds

(57) ABSTRACT

A container includes a plurality of walls extending upward from a base. At least one support is movable between a retracted position and a support position. The base includes projections downwardly from each corner of the base for interlocking with a larger container stacked thereunder.

17 Claims, 11 Drawing Sheets

COLLAPSIBLE CONTAINER

BACKGROUND OF THE INVENTION

The present invention relates generally to crates and more particularly to a collapsible crate with interlocking members for stacking on another container.

Collapsible crates are well known. Four walls each connected via a hinge to a base are selectively movable about the hinge between a use position, in which the wall is generally perpendicular to the base, and a collapsed position onto the base. Various latch mechanisms have been provided to connect adjacent walls at the corner to selectively lock the crate in the use position.

Some collapsible crates also include retractable supports so that another, non-collapsible, nestable container can be supported thereon. One such collapsible crate includes end walls each having a support that is partially supported on the adjacent walls when in the support position. The nestable containers can be supported on the supports when the supports are in the support position.

The nestable containers are sometimes stacked on larger containers with approximately twice the footprint, such that two such nestable containers are stacked on each larger container. One side wall of each container is supported by pegs adjacent an end wall of the larger container, while corners adjacent the opposite side wall of each container are supported on a platform protruding into the center of the larger container. The platform includes ribs that space the two containers away from one another to keep them in place. However, the collapsible crates have a larger footprint than the nestable containers and therefore do not interact with the pegs adjacent the end walls of the larger containers. Therefore, the collapsible crates cannot be stacked reliably on the larger containers.

SUMMARY OF THE INVENTION

The present invention provides a container having a plurality of walls extending upwardly from a base. The base includes at least one projection (or "tab") downwardly for interlocking with the platform on the larger container. This provides a more stable stacking of the containers on the larger containers.

DETAILED DESCRIPTION OF THE PREFERRED EMBODIMENTS

Figure 1:
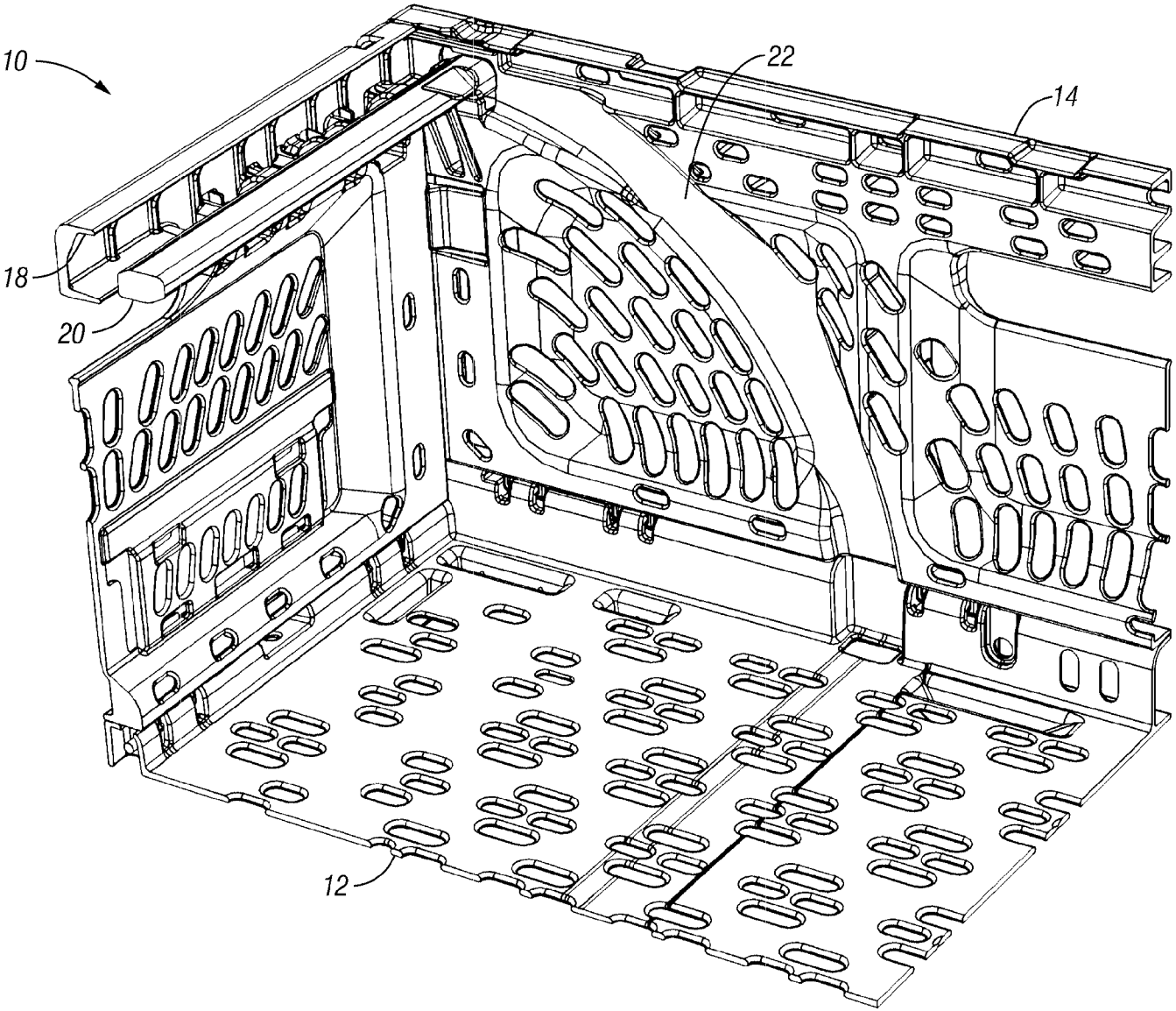
FIG. 1 is a perspective view of an interior corner of a container according to one embodiment of the present invention with its walls in an assembled, upright, use position.

FIG. 1 is an interior perspective view of a quarter of a container 10. The remainder of the container 10 would be symmetric. The container 10 includes a base 12, upstanding side walls 14 (or long walls) and upstanding end walls 18 (or short walls). The side walls 14 and end walls 18 are pivotably connected along long and short edges of the base 12, respectively. The end walls 18 are collapsible onto the base 12, and the side walls 14 are collapsible onto the end walls 18.

Figure 2:
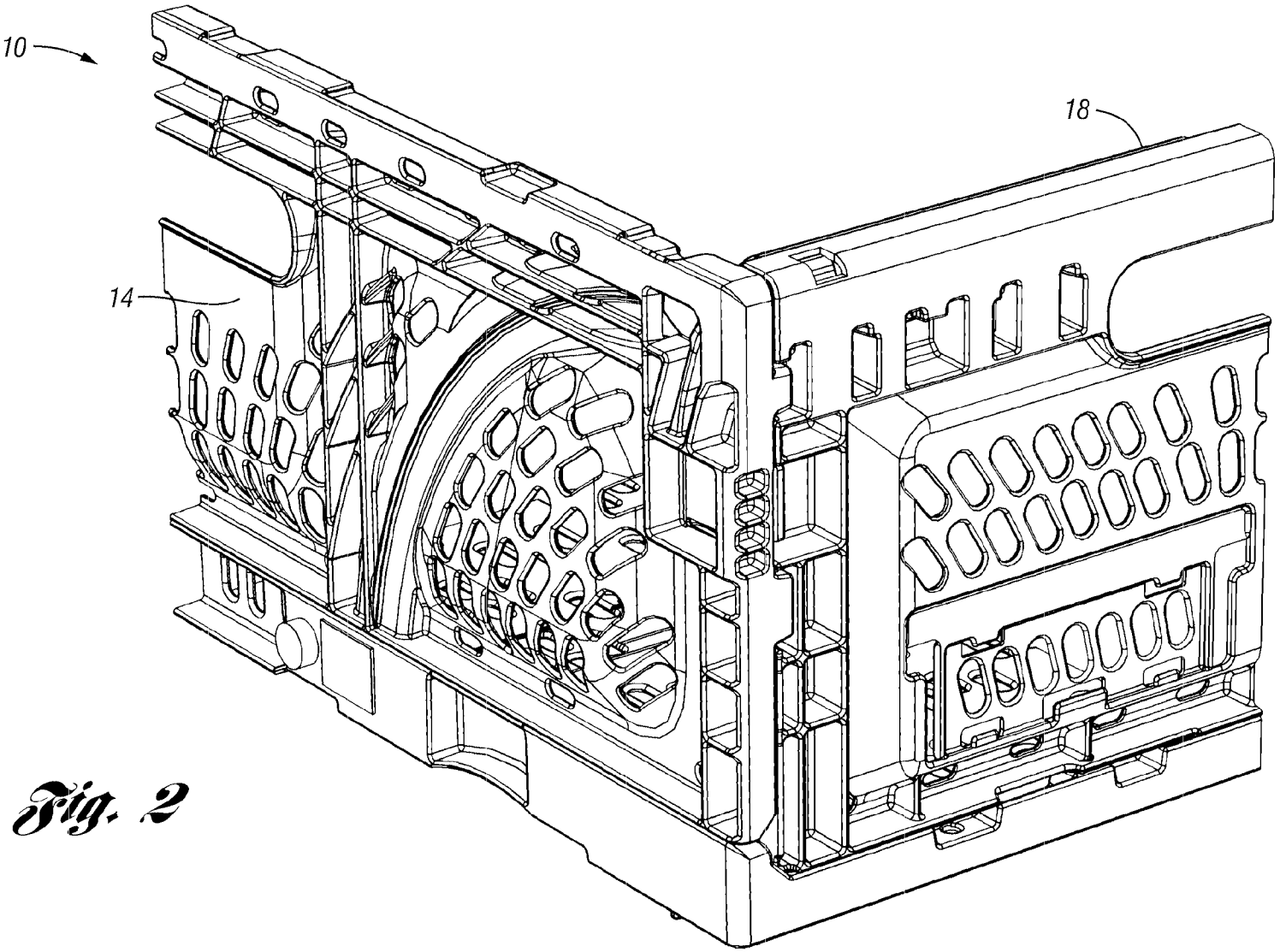
FIG. 2 is an exterior perspective view of the container of FIG. 1.

Each end wall 18 has a support 20. The support 20 is pivotably and slidably mounted the end wall 18 and movable between a retracted position and a support position. The support 20 is shown in FIG. 1 pivoted to the support position, where it projects into the interior of the container 10 where it can support another container stacked thereon. The supports 20 project into arcuate channels 22 formed in each side wall 14. The ends of the supports 20 move in the arcuate channels 22 as the end walls 18 are collapsed onto the base 12. FIG. 2 is an exterior view of the corner of the container 10 of FIG. 1.

Figure 3:
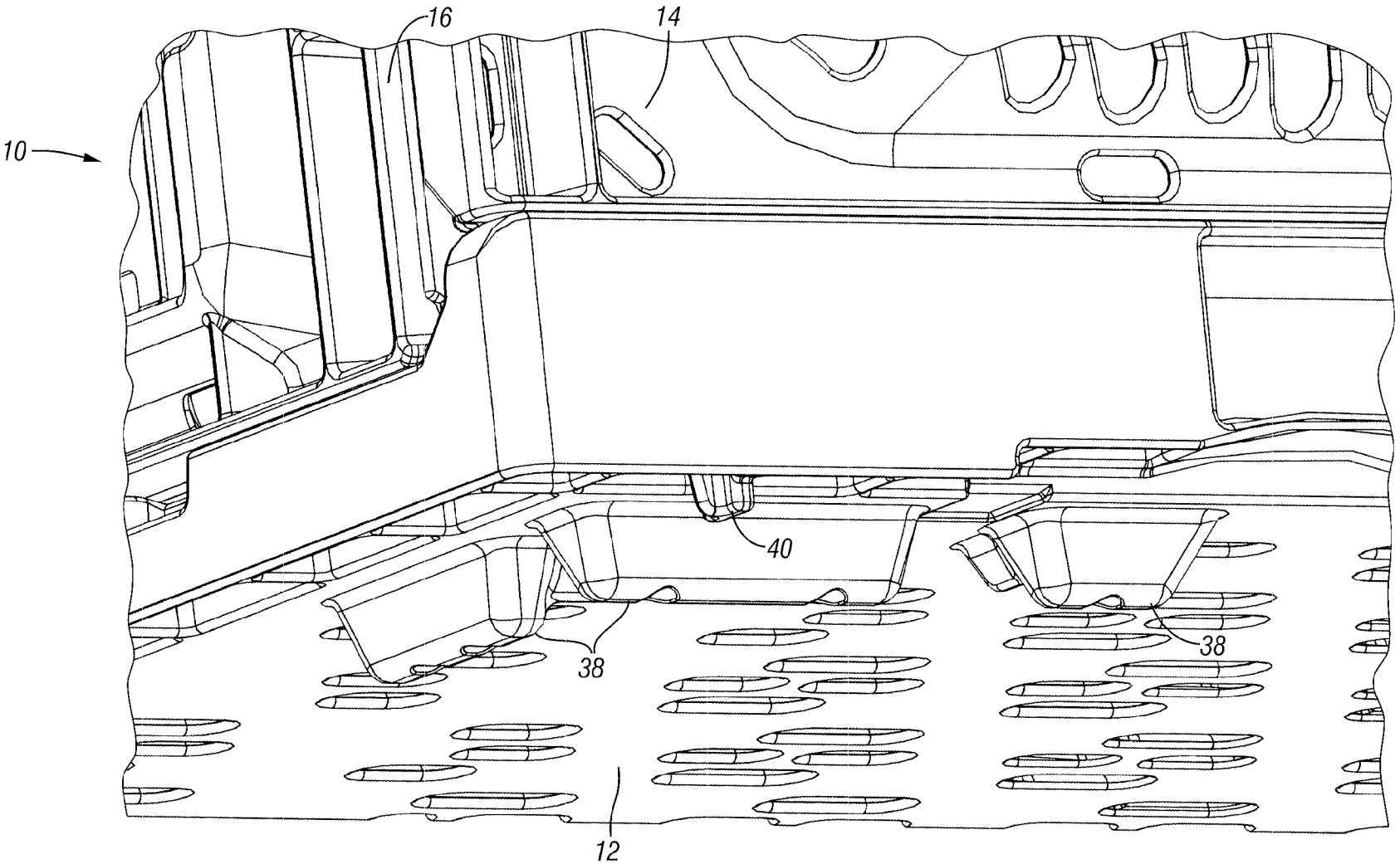
FIG. 3 is a bottom perspective view of one of the corners of the container of FIG. 1.
Figure 4:
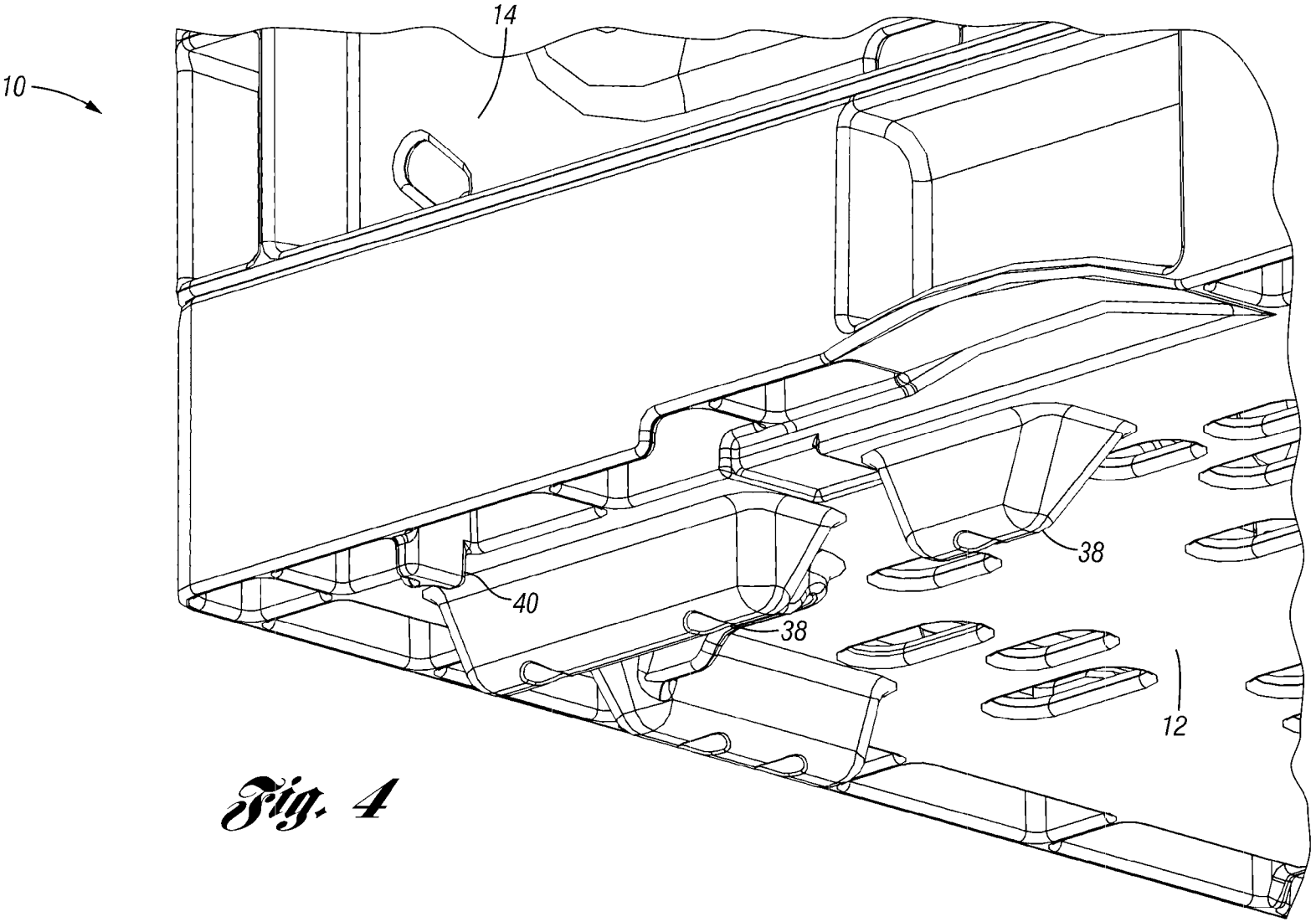
FIG. 4 is another bottom perspective view of the corner of FIG. 3.

FIGS. 3 and 4 are bottom perspective views of one of the corners of the container 10. As shown, a plurality of feet 38 protrude downwardly from the base 12. A projection 40 (or "tab") protrudes downwardly from the base 12 adjacent one of the side walls 14. The projection 40 protrudes downwardly from the base 12 less than the feet 38 do. The other corners of the container 10 would be similar.

Figure 5:
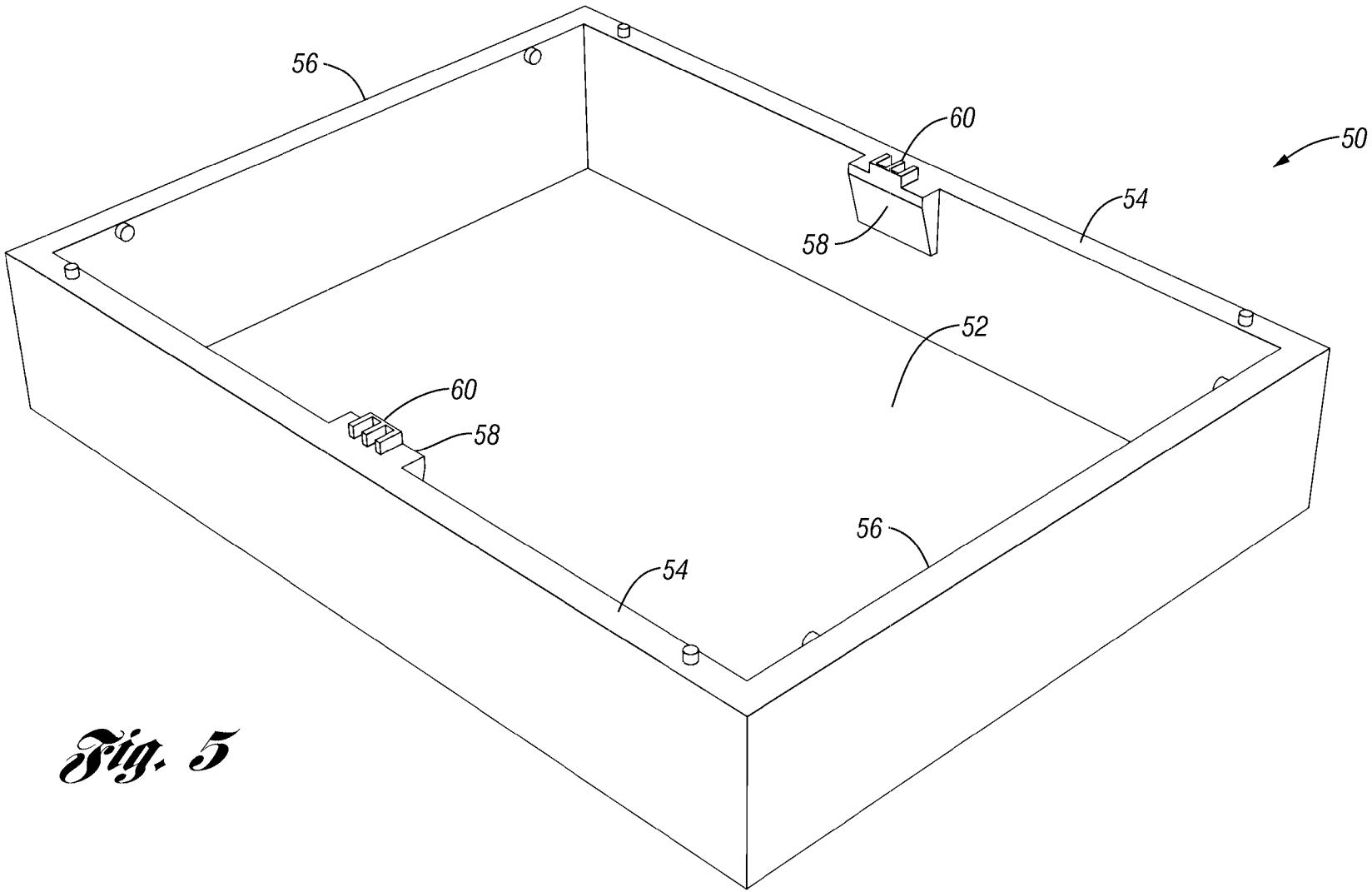
FIG. 5 is a perspective view of a larger container.

FIG. 5 illustrates a larger container 50 having side walls 54 and end walls 56 (which may or may not be collapsible) extending upwardly from a base 52. Near the upper edge of each side wall 54, a platform 58 protrudes inwardly from the center of each side wall 54. The platform 58 includes a plurality of spaced apart ribs 60 on an upper surface thereof.

Figure 6:
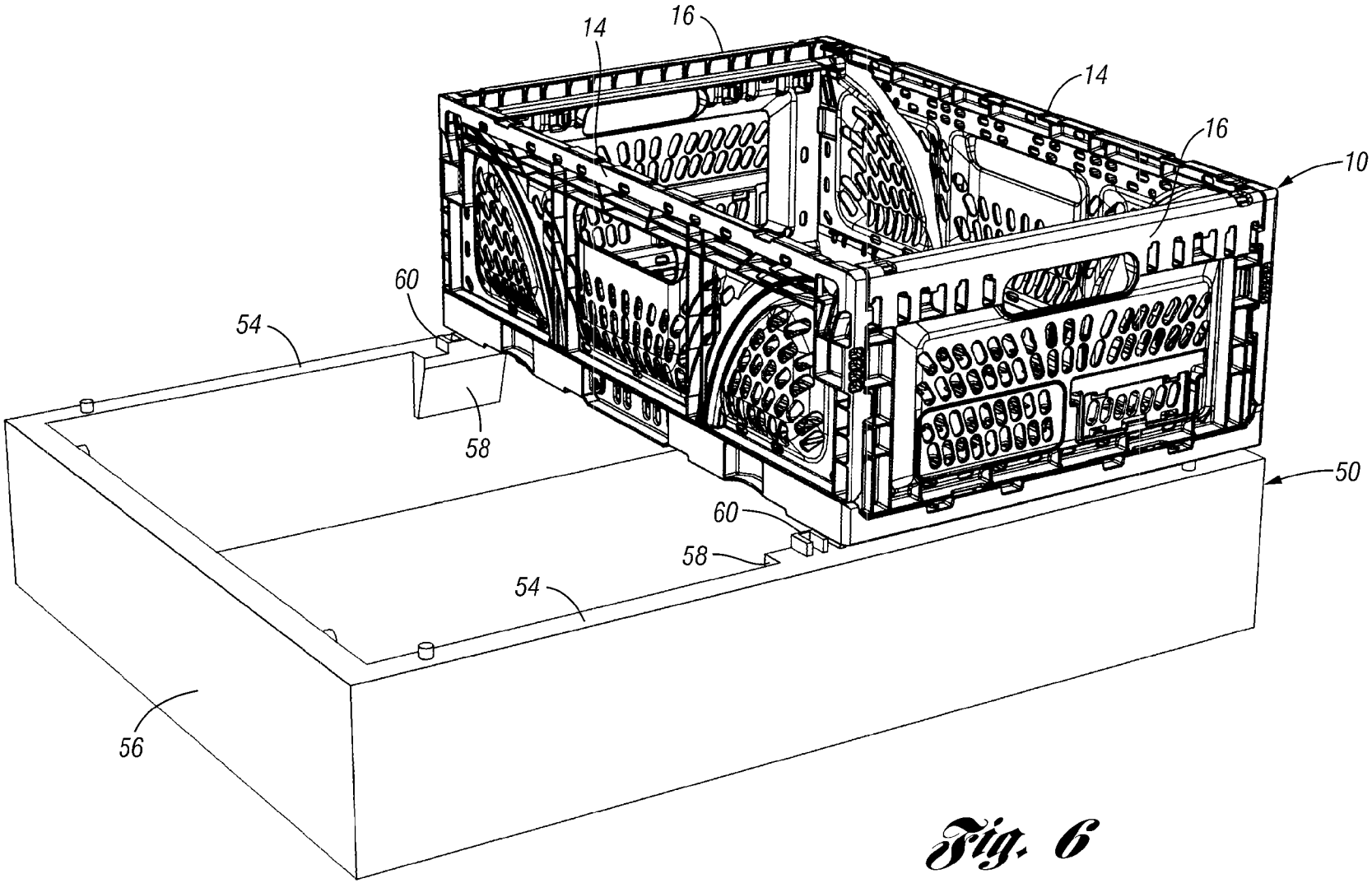
FIG. 6 is a perspective view of the container of FIG. 1 stacked on the container of FIG. 5.

As shown in FIG. 6, the container 10 is stackable onto the larger container 50. The larger container 50 has a footprint that is approximately twice that of the container 10, such that two such containers 10 could be stacked on the larger container 50. The end walls 18 of the container 10 are supported on the side walls 54 of the larger container 50. At one side, the corners of the base 12 are supported on the platforms 58 of the larger container 50.

Figure 7:
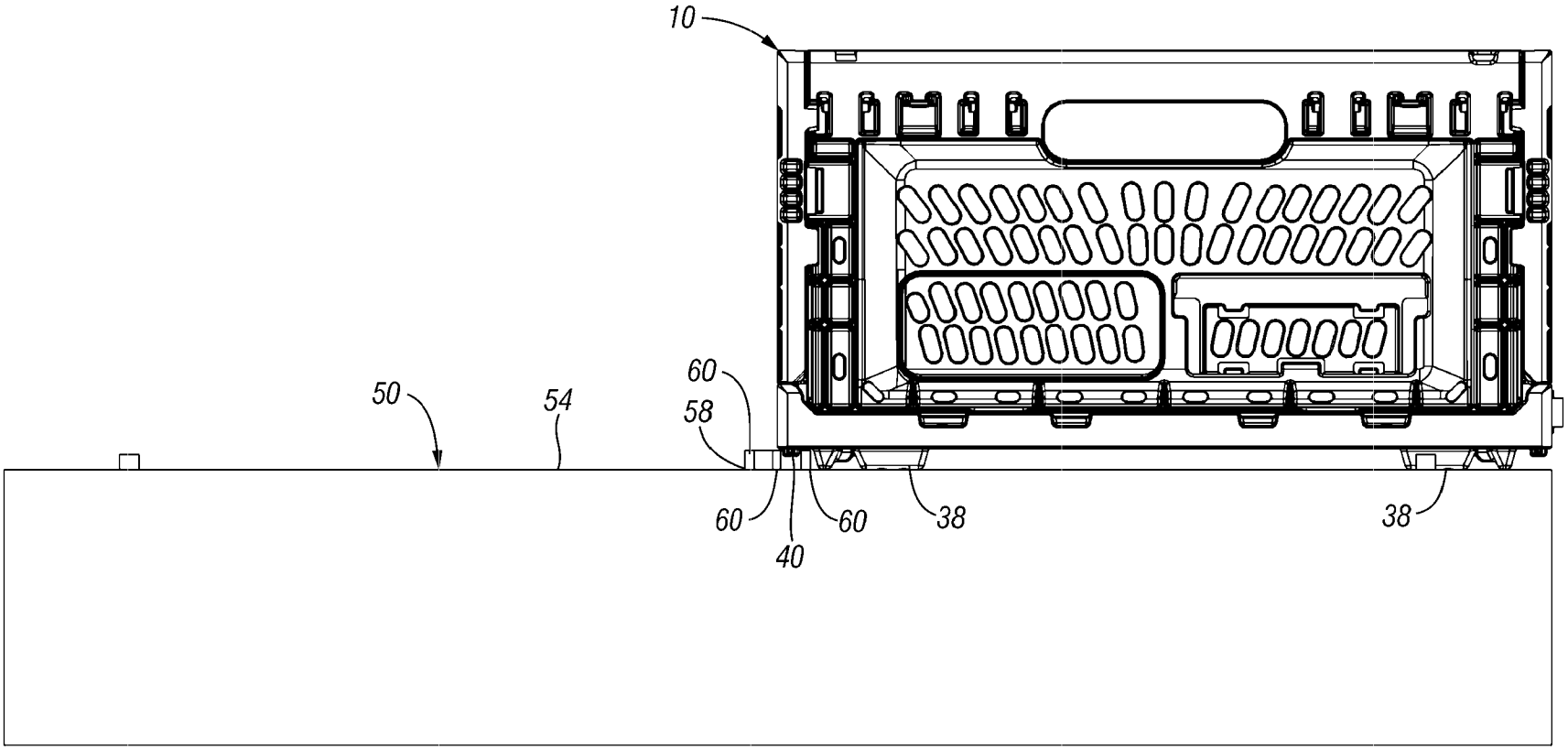
FIG. 7 is a side view of the containers of FIG. 6.
Figure 8:
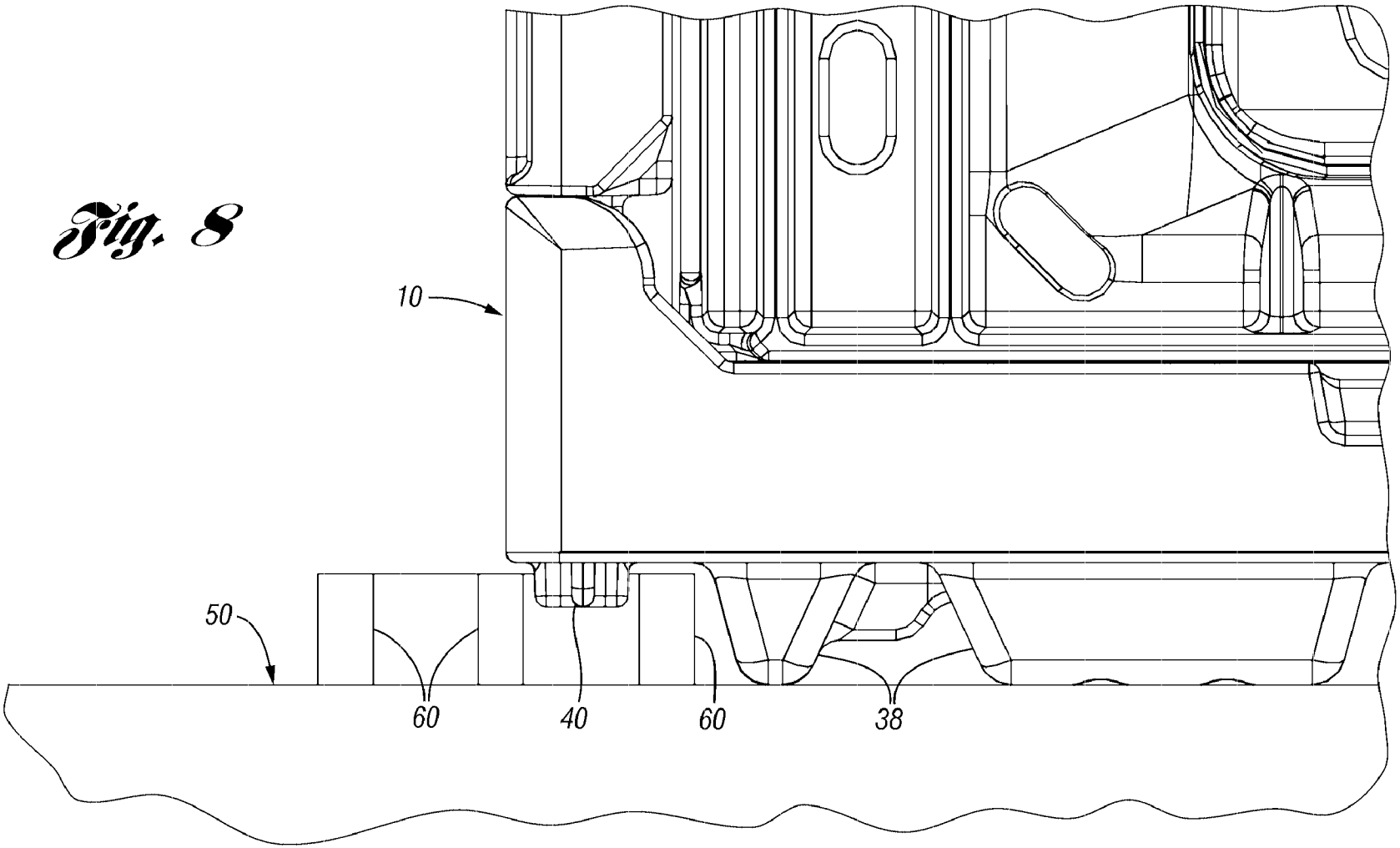
FIG. 8 is an enlarged view of a portion of FIG. 7.

As can be seen in FIG. 7, the feet 38 actually rest on the side walls 54 of the larger container 50. In order to hold the container 10 in place on the larger container 50, the projections 40 interlock with the ribs 60 on the platforms 58. Referring the FIG. 8, the projections 40 are received between the ribs 60 to prevent the container 10 from sliding off of the larger container 50. Another container 10 would similarly stack on the larger container 50, with its projections 40 received between the remaining ribs 60. The container 10 therefore has increased stability on the known larger containers 50.

Figure 9:
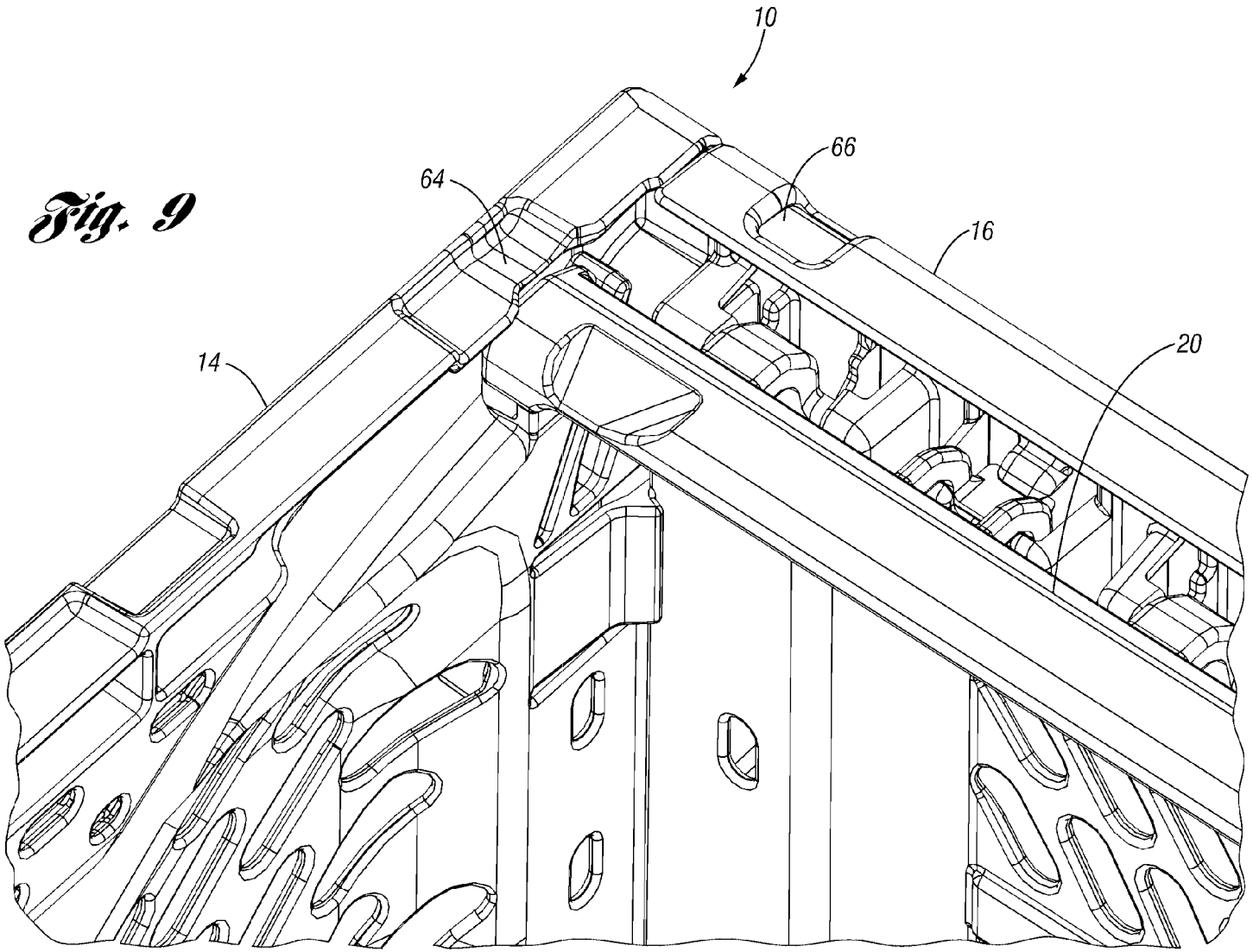
FIG. 9 is an enlarged interior perspective of the corner of FIG. 1.

Referring to FIG. 9, in order to accommodate the projections 40, recesses 64 are formed in the top of the side walls 14, for receiving the projections 40 of a container 10 stacked thereon. Recesses 66 are formed in the top of the end walls 18 for receiving the projections 40 of the similar container when cross-stacked thereon.

Figure 10:
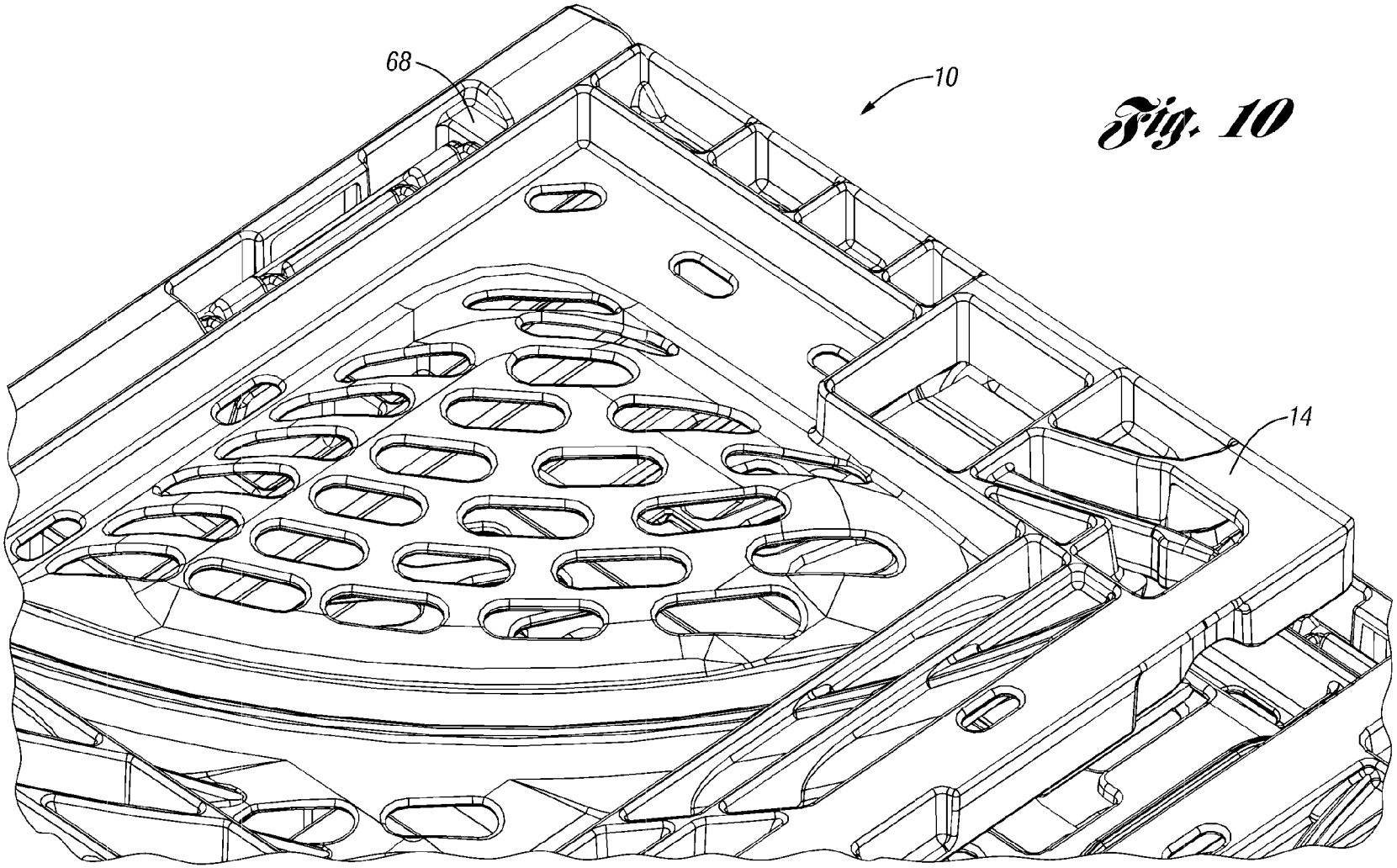
FIG. 10 is an enlarged view of a corner of the container of FIG. 1 in the collapsed position.

Referring to FIG. 10, recesses 68 are formed in the lower exterior surfaces of the side walls 14 to accommodate the projections 40 of the similar container 10 when stacked in the collapsed position.

Figure 11:
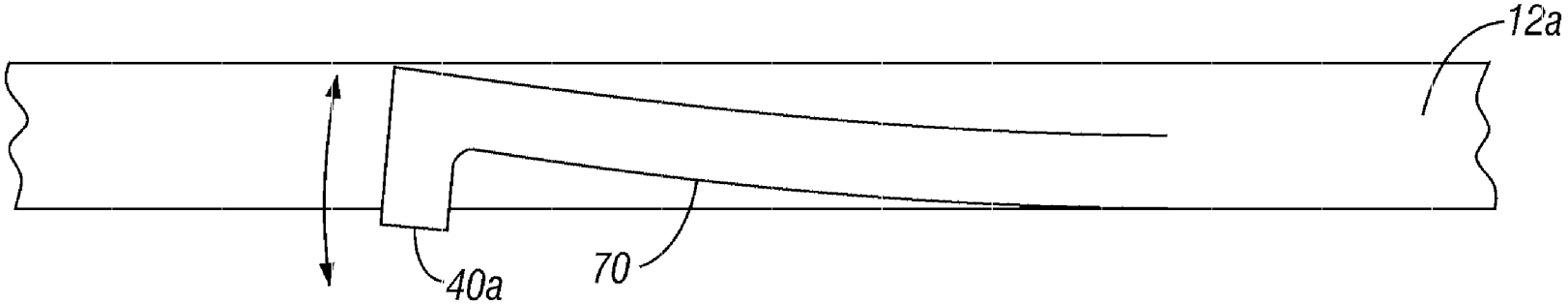
FIG. 11 is a section view through a portion of an alternative base for the container of FIG. 1.
Figure 12:
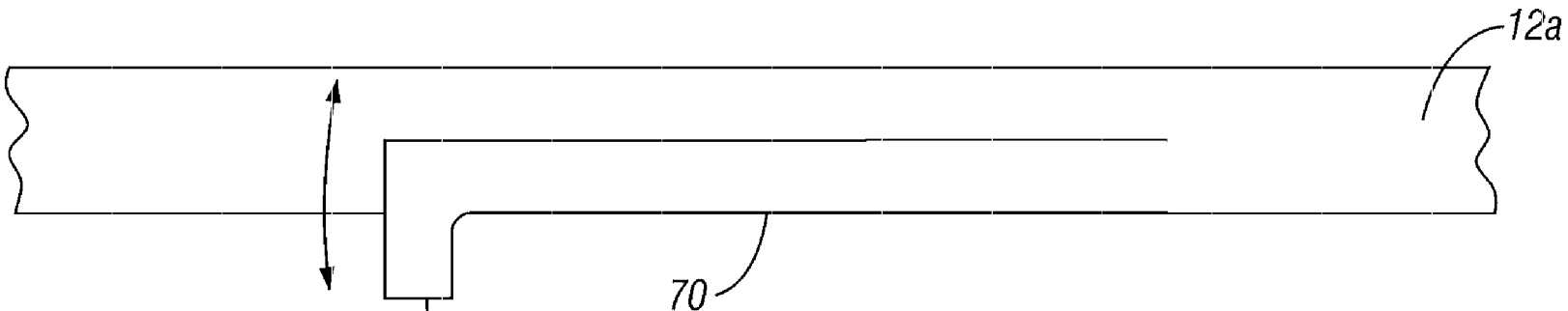
FIG. 12 is the portion of the base of FIG. 11 with the projection deployed.

FIG. 11 is a section view through a portion of an alternative base 12*a* for the container of FIG. 1. In each corner, in the same locations as the embodiment of FIGS. 1-10, a projection 40*a* is formed on an end of a cantilevered arm 70 formed integrally with the base 12*a*. Instead of (or in addition to) forming the recesses 64, 66, 68 described with respect to FIGS. 9 and 10, the projections 40*a* would retract into the base 12*a* upon contact with a surface of another container, but would still provide the interlocking function when stacked on the larger container 50 (FIG. 5). FIG. 12 shows the portion of the base 12*a* of FIG. 11 with the projection 40*a* deployed. Other types of springs or resilient structures could be used to provide a retractable projection 40*a*.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A container comprising:

a base;

a plurality of walls extending upward from the base, the plurality of walls including a first wall adjacent a second wall;

a support mounted to the first wall and movable relative to the first wall between a retracted position and a support position, wherein the support extends further into a mouth of the container and is supported on the adjacent second wall in the support position;

a projection downward from each of four corners of the base, the projections formed integrally with the base; and a plurality of feet protruding downwardly from the base and formed integrally with the base, the plurality of feet protruding downwardly more than the projections.

2. The container of claim 1 wherein the plurality of walls are collapsible onto the base.

3. The container of claim 2 wherein the container is an upper container stacked on a larger, lower container with a pair of stacking platforms extending into a mouth of the lower container, each stacking platform including a recess into which is received one of the projections of the upper container.

4. The container of claim 2 wherein the second wall includes an upper edge having a recess formed therein for receiving one of the projections of a similar container stacked thereon.

5. The container of claim 4 wherein the first wall includes an upper edge having a recess formed therein for receiving one of the projections of the similar container cross stacked thereon.

6. The container of claim 4 wherein the second wall includes a side recess formed in a lower exterior surface for receiving the projection of the similar container when stacked on the container in a collapsed position.

7. The container of claim 1 wherein the projection is retractable relative to the base.

8. The container of claim 7 wherein the projection is formed on a flexible structure integrally formed with the base.

9. The container of claim 1 wherein the plurality of walls are hingeably connected to the base and pivotable between and upright position and a collapsed position on the base and wherein the plurality of feet are spaced inward from a periphery of the container such that the feet are not directly below the plurality of walls when the walls are in the upright position.

10. The container of claim 1 wherein the plurality of feet are spaced inward from a periphery of the container such that the feet are not directly below the plurality of walls.

11. A container comprising:

a base;

a plurality of walls extending upward from the base, the plurality of walls including a first wall adjacent a second wall, the plurality of walls hingeably connected to the base and collapsible onto the base;

a support mounted to the first wall and movable relative to the first wall between a retracted position and a support position;

a plurality of feet protruding downwardly from the base; and at least one tab projecting downwardly from each of a plurality of corners of the base, the at least one tab projecting downwardly less than the plurality of feet, wherein the second wall includes an upper edge having a recess formed therein for receiving one of the tabs of a similar container stacked thereon and the first wall includes an upper edge having a recess formed therein for receiving one of the tabs of the similar container cross stacked thereon.

12. The container of claim 11 wherein the container is an upper container stacked on a larger, lower container with a pair of stacking platforms extending into a mouth of the lower container, each stacking platform including a recess into which is received one of the tabs of the upper container.

13. The container of claim 11 wherein the second wall includes a side recess formed in a lower exterior surface for receiving the tab of the similar container when stacked on the container in a collapsed position.

14. The container of claim 11 wherein the at least one tab is formed on a flexible structure integrally formed with the base such that the at least one tab is retractable relative to the base.

15. A container comprising:

a base;

a plurality of walls extending upward from the base, the plurality of walls including a first wall adjacent a second wall;

a support mounted to the first wall and movable relative to the first wall between a retracted position and a support position; and a projection downward from each of four corners of the base, wherein the projections are retractable relative to the base.

16. The container of claim 15 wherein the projections are each formed on a flexible structure integrally formed with the base.

17. A container comprising:

a base;

a plurality of walls extending upward from the base, the plurality of walls including a first wall adjacent a second wall, the plurality of walls hingeably connected to the base and collapsible onto the base;

a support mounted to the first wall and movable relative to the first wall between a retracted position and a support position;

a plurality of feet protruding downwardly from the base; and at least one tab projecting downwardly from each of a plurality of corners of the base, the at least one tab projecting downwardly less than the plurality of feet, wherein the at least one tab is formed on a flexible structure integrally formed with the base such that the at least one tab is retractable relative to the base.

* * * * *